US008033422B2

(12) United States Patent
Estrada

(10) Patent No.: US 8,033,422 B2
(45) Date of Patent: Oct. 11, 2011

(54) PILL DISPENSER

(76) Inventor: Luis F. Villegas Estrada, Torrance, CA (US)

( * ) Notice: Subject to any disclaimer, the term of this patent is extended or adjusted under 35 U.S.C. 154(b) by 240 days.

(21) Appl. No.: 12/314,849

(22) Filed: Dec. 17, 2008

(65) Prior Publication Data

US 2010/0147867 A1 Jun. 17, 2010

(51) Int. Cl.
*B65D 83/04* (2006.01)
*E05B 65/52* (2006.01)

(52) U.S. Cl. ..... 221/89; 221/69; 221/154

(58) Field of Classification Search ..... 221/69, 221/89, 91, 92, 103, 112, 113, 119–121, 221/133, 154, 312 R, 312 A, 312 C
See application file for complete search history.

(56) References Cited

U.S. PATENT DOCUMENTS

| | | | | |
|---|---|---|---|---|
| 4,069,942 | A | 1/1978 | Marshall et al. | |
| 4,083,452 | A * | 4/1978 | Rossmo | 206/533 |
| 4,124,143 | A * | 11/1978 | Thomas | 221/82 |
| 4,261,468 | A | 4/1981 | Krebs | |
| 5,762,199 | A | 6/1998 | Aguilera | |
| 5,782,359 | A | 7/1998 | McAllister et al. | |
| D398,444 | S | 9/1998 | Ricci | |
| 5,921,394 | A | 7/1999 | Shroff | |
| 6,126,010 | A | 10/2000 | Kogen | |
| 6,302,777 | B1 * | 10/2001 | Zoldan | 453/54 |
| 6,325,241 | B1 | 12/2001 | Garde et al. | |
| 6,382,410 | B1 | 5/2002 | Magid et al. | |
| D469,700 | S | 2/2003 | Ng | |
| 6,758,338 | B2 | 7/2004 | Lien | |
| 7,147,127 | B2 | 12/2006 | Lepke et al. | |
| 7,159,720 | B2 * | 1/2007 | Pearson | 206/533 |
| 7,543,718 | B2 * | 6/2009 | Simon | 221/13 |
| 2005/0205458 | A1 * | 9/2005 | Pearson | 206/538 |
| 2009/0200332 | A1 * | 8/2009 | Intini | 221/154 |
| 2009/0223989 | A1 * | 9/2009 | Gelardi | 221/1 |

FOREIGN PATENT DOCUMENTS

| | | | |
|---|---|---|---|
| GB | 2116153 | A | 9/1983 |
| WO | WO 2004/026728 | A1 | 4/2004 |

* cited by examiner

*Primary Examiner* — Gene Crawford
*Assistant Examiner* — Kelvin L Randall, Jr.
(74) *Attorney, Agent, or Firm* — Richard C. Litman

(57) ABSTRACT

The pill dispenser is a rotary container and dispenser for medications and the like. The pill dispenser includes a base having a lower wall and a plurality of radially extending inner walls mounted on an upper surface of the lower wall. The plurality of radially extending inner walls define a plurality of pill-receiving compartments therebetween. Additionally, a plurality of peripheral walls are mounted on the upper surface of the lower wall, with each peripheral wall partially extending between an adjacent pair of the plurality of radially extending inner walls to define an access opening therebetween. A cover, mounted on the base, includes an upper wall and a circumferential sidewall secured to a lower surface of the upper wall. An opening is formed in the circumferential sidewall. A locking device is further provided for selectively locking rotation of the cover with respect to the base, controlling access to the compartments.

11 Claims, 5 Drawing Sheets

PILL DISPENSER

BACKGROUND OF THE INVENTION

1. Field of the Invention

The present invention relates to containers and dispensers for pills, tablets and the like.

2. Description of the Related Art

Containers for pills, tablets and the like are well known in the art. A typical container is generally configured as a small box or the like, providing an easily transportable housing for the medication. However, such containers are typically designed for a single usage and are not well adapted for multiple medications which must be taken at different times or on differing days, or for single medications which must be taken multiple times per day or on successive days.

Additionally, such typical containers do not include locking devices, which may be necessary in order to prevent accidental spillage of the contents of the container, or to prevent access to the medication by children. Thus, a pill dispenser solving the aforementioned problems is desired.

SUMMARY OF THE INVENTION

The pill dispenser is a rotary container and dispenser for medications and the like. The pill dispenser includes a base having a lower wall and a plurality of radially extending inner walls mounted on an upper surface of the lower wall. The plurality of radially extending inner walls define a plurality of pill-receiving compartments therebetween. Additionally, a plurality of peripheral walls are mounted on the upper surface of the lower wall, with each peripheral wall partially extending between an adjacent pair of the plurality of radially extending inner walls to define an access opening therebetween.

A central hub is further mounted on the upper surface of the lower wall of the base, with an axial bore being formed therethrough. The central hub allows for rotational mounting of a cover on the base. The cover includes an upper wall and a circumferential sidewall secured to a lower surface of the upper wall. An opening is formed in the circumferential sidewall. A shaft is centrally mounted on the lower surface of the upper wall of the cover, so that the shaft is received within the axial bore of the base.

The cover is secured to the base, preferably through at least one rib formed on an outer face of each peripheral wall of the base. A complementary circumferential groove is formed on an inner face of the circumferential sidewall of the cover for receiving the plurality of ribs.

A locking device is further provided for selectively locking rotation of the cover with respect to the base. The locking device is received within a locking housing formed on the base. In use, the cover is selectively rotated to align the opening formed through the circumferential sidewall thereof with a selected one of the access openings, providing access to one of the pill-receiving compartments.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
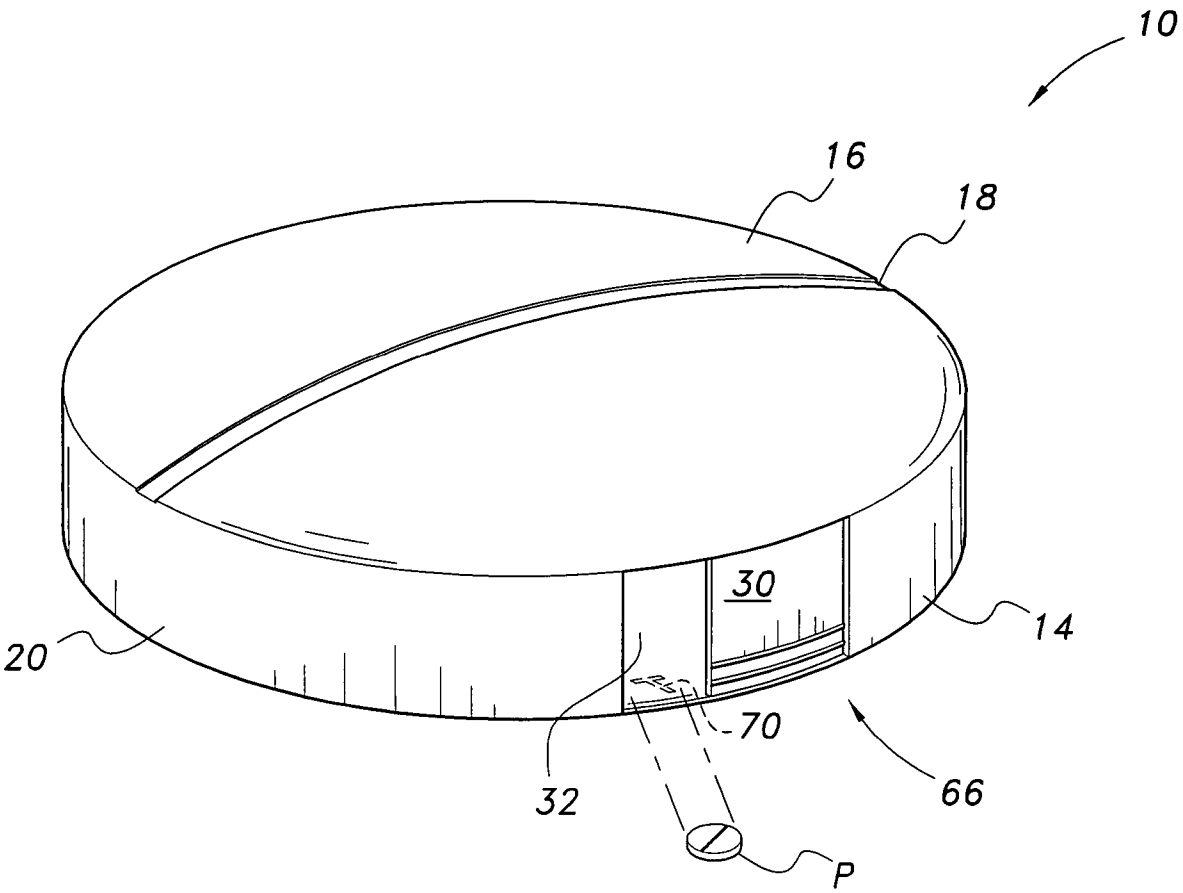
FIG. 1 is a perspective view of a pill dispenser according to the present invention.
Figure 2:
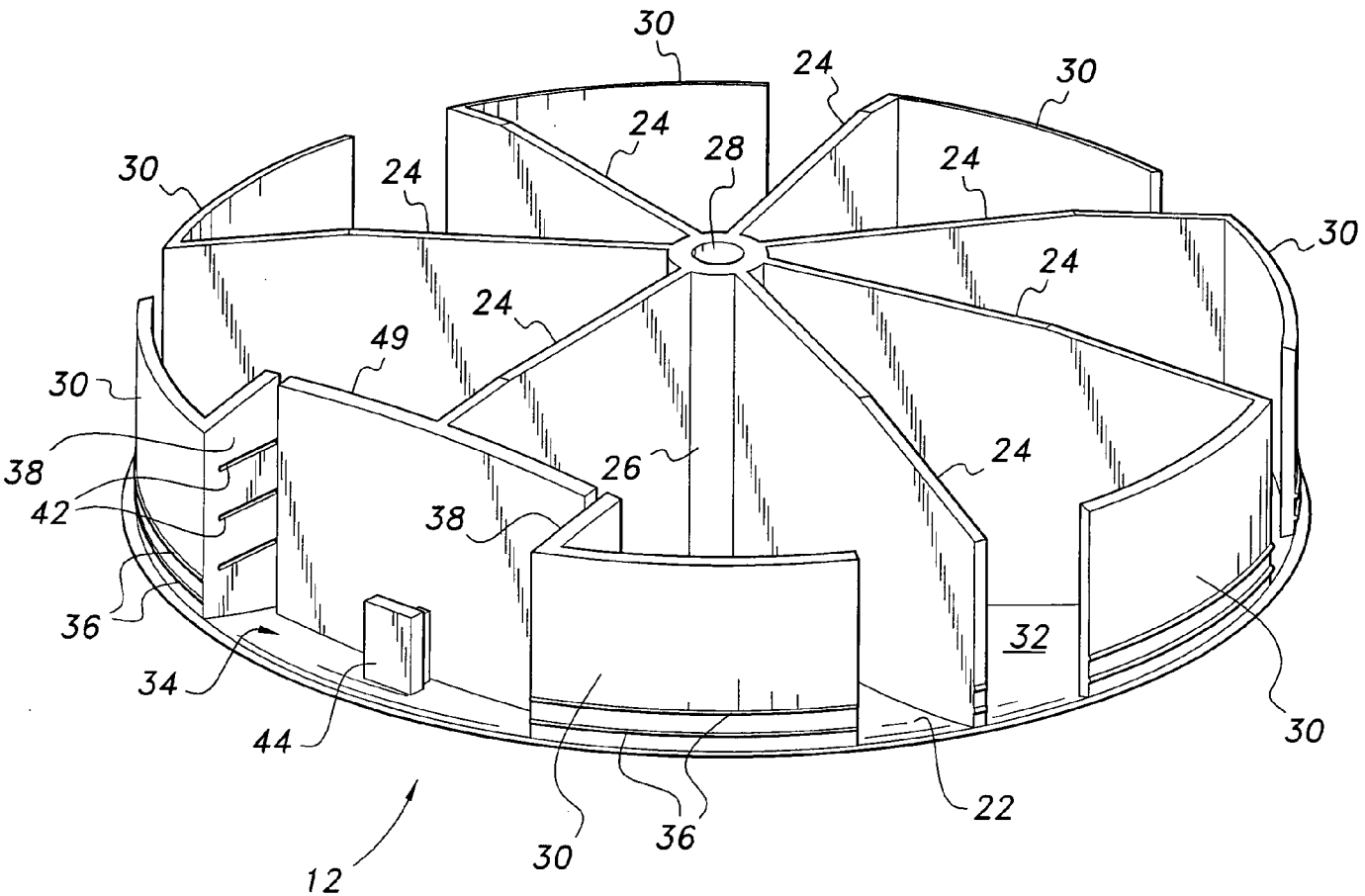
FIG. 2 is a perspective view of a base of the pill dispenser according to the present invention.
Figure 5:
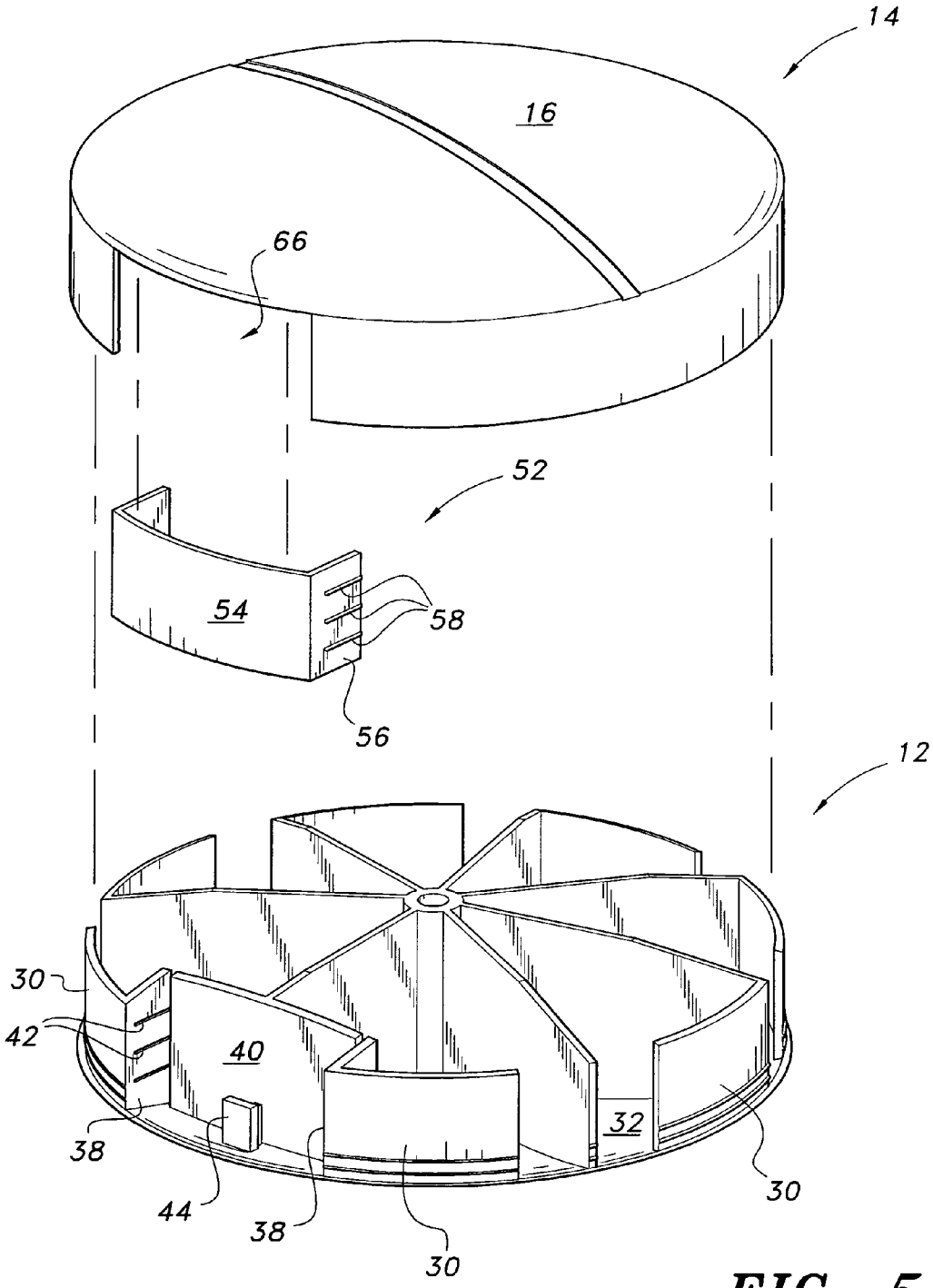
FIG. 5 is an exploded, perspective view of the pill dispenser according to the present invention.

Now referring to FIG. 1, there is shown a rotary container and dispenser for medications and the like. It should be understood that pill P is shown for exemplary purposes only, and that pill dispenser 10 may be used to store and dispense any desired article or articles. As best shown in FIGS. 2 and 5, pill dispenser 10 includes a base 12 having a lower wall 22 and a plurality of radially extending inner walls 24 mounted on an upper surface of the lower wall 22. The plurality of radially extending inner walls 24 define a plurality of pill-receiving compartments 32 therebetween. Preferably, seven such compartments 32 are provided, allowing the storing of one week's supply of medication, to be dispensed each day. It should be understood that any desired number of walls 24 may be provided to define any desired number of compartments 32. As shown in FIG. 1, indicia 70 may be provided on the upper surface of lower wall 22 within each compartment in order to label a day of the week, for example.

Additionally, a plurality of peripheral walls 30 are mounted on the upper surface of the lower wall 22, with each peripheral wall 30 partially extending between an adjacent pair of the plurality of radially extending inner walls 24 to define an access opening therebetween. Preferably, lower wall 22 has a circular contour, as shown, and peripheral walls 30 are formed with substantially constant radii of curvature. Base 12 may be formed from plastic or any other suitable rugged and easily transportable material.

Figure 3:
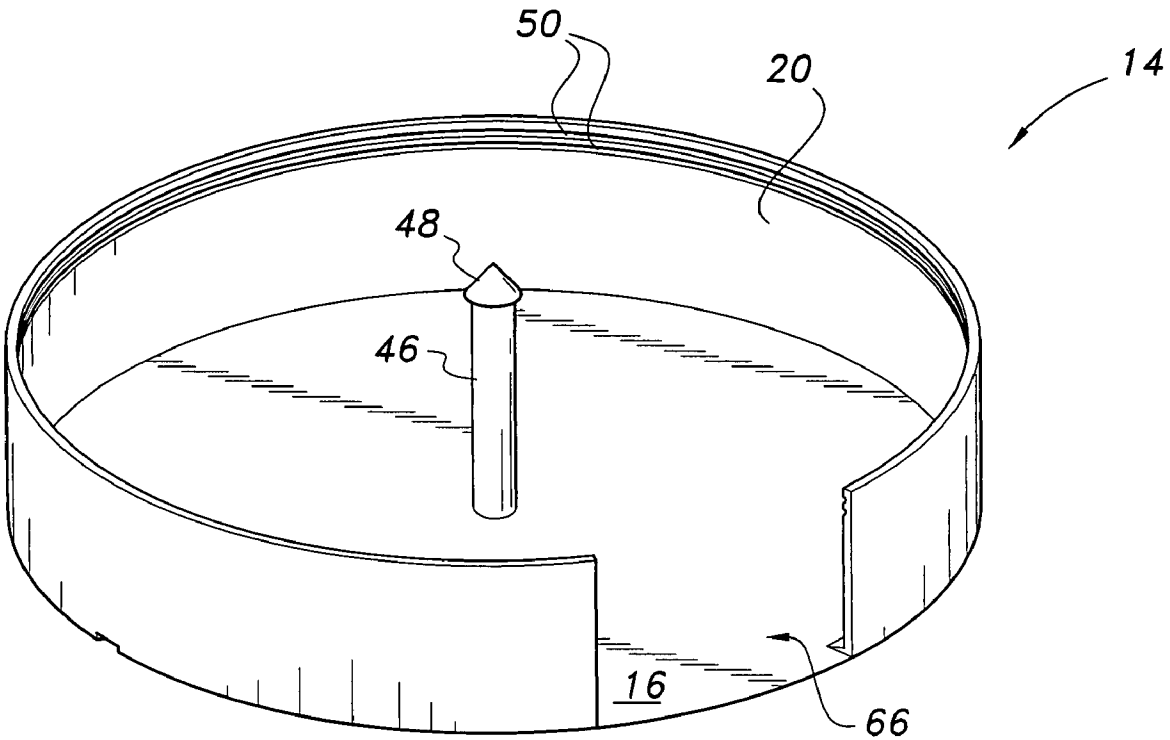
FIG. 3 is a bottom, perspective view of a cover of the pill dispenser according to the present invention.

A central hub 26 is further mounted on the upper surface of the lower wall 22 of the base 12, as shown, with an axial bore 28 being formed therethrough. The central hub 26 allows for rotational mounting of a cover 14 on the base 12. As best shown in FIG. 3, the cover 14 includes an upper wall 16 and a circumferential sidewall 20 secured to a lower surface of the upper wall 16. An opening 66 is formed in the circumferential sidewall, as shown. Further, a shaft 46 is centrally mounted on the lower surface of the upper wall 16 of the cover 14, so that the shaft 46 is received within the axial bore 28 of the central hub 26 of base 12. Shaft 46 may be provided with a locking head 48 in order to prevent removal of the shaft 46 from within axial bore 28. Cover 14 preferably has a circular contour, as shown, for mating with the circular base 12.

The cover 14 is additionally secured to the base 12 through at least one rib 36 formed on an outer face of each peripheral wall 30 of base 12 (here shown as having an exemplary pair of ribs 36 formed on each peripheral wall 30). A complementary at least one circumferential groove 50 (shown in FIG. 3 as a pair of grooves 50) is formed on an inner face of the circumferential sidewall 20 of the cover 14 for receiving the plurality of ribs 36. As shown, ribs 36 are preferably formed on peripheral walls 30 adjacent the lower wall 22, and grooves 50 are preferably formed adjacent the lower edge (opposite upper wall 16) of circumferential sidewall 20. Similar to base 12, cover 14 is preferably formed from plastic or any other suitable rugged and easily transportable material. As shown in FIG. 1, the upper surface of upper wall 16 may be provided with an ornamental groove 18 to simulate a medicinal pill. It should be understood that the upper surface may include any desired ornamentation or indicia, such as a "smiley face".

A locking device is further provided for selectively locking rotation of the cover 14 with respect to the base 12. The locking device is preferably provided in the form of a locking button 52, best shown in FIG. 4, which is received within a locking recess 34, formed on the base 12. Locking button 52 is also preferably formed from plastic or any other suitable material.

Figure 4:
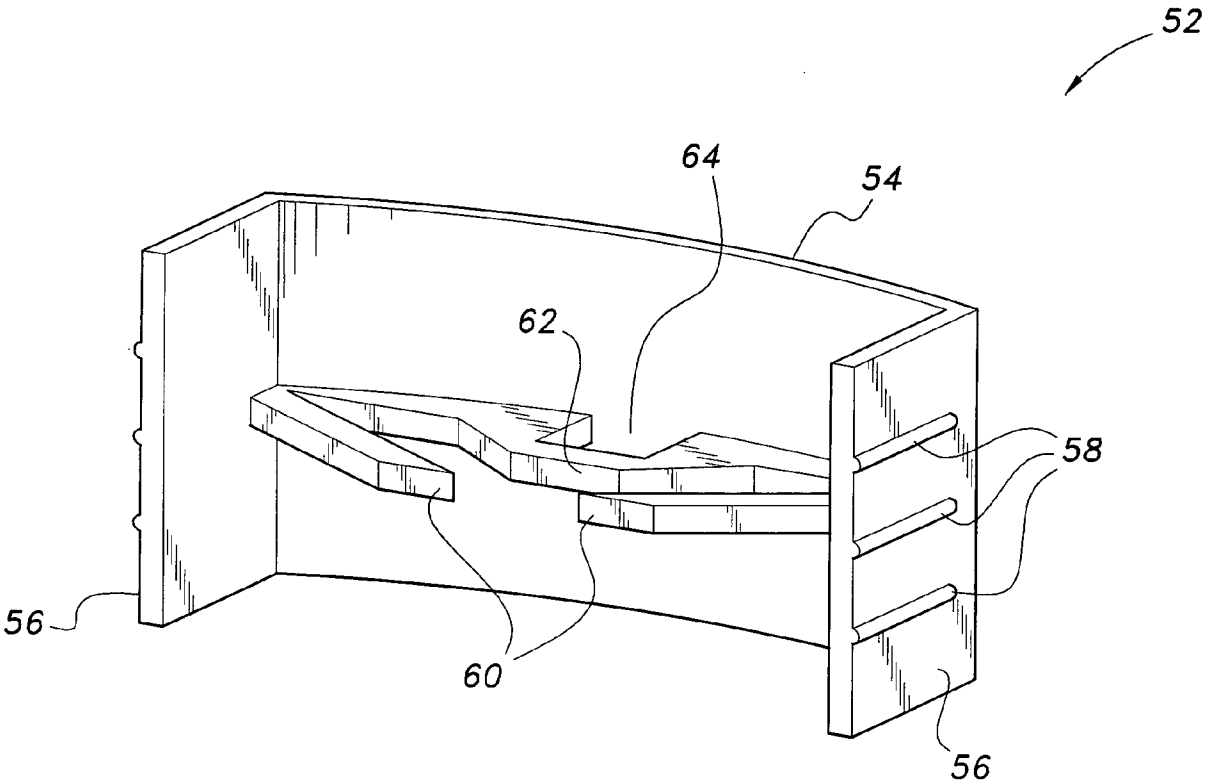
FIG. 4 is a rear, perspective view of a locking button of the pill dispenser according to the present invention.

As shown in FIG. 4, the locking button 52 includes a front wall 54 and a pair of sidewalls 56 secured to the front wall 54 and extending rearwardly therefrom. As will be described in greater detail below, the front wall 54 is positioned within opening 66 of cover 14 when the pill dispenser is in a locked position. Front wall 54 preferably has an arcuate contour with a radius of curvature being substantially equal to that of circumferential sidewall 20. Further, front wall 54 preferably has a width equal to the circumferential width of opening 66.

Further, as shown in FIG. 4, a support 62 is centrally mounted to a rear face of the front wall 54, and the support 62 has an opening 64 formed therethrough. At least one biasing member 60 is mounted to the support and extends rearwardly therefrom. Any suitable biasing member may be utilized. As shown in FIG. 4, a pair of angled plastic members are preferably formed on laterally opposed ends of support 62 and project inwardly and rearwardly therefrom.

As best shown in FIG. 2, the locking recess 34 is defined by a pair of locking sidewalls 38 and a locking rear wall 40 mounted on the upper surface of the lower wall 22 of the base 12. An engaging member 44 is further mounted to the upper surface of the lower wall 22, adjacent to, and positioned forwardly therefrom, the locking rear wall 40. The engaging member 44 slidably received within the opening 64 of support 62 in order to secure the locking button 52 within locking recess 34. Further the at least one biasing member 60 contacts a front face of the locking rear wall 40.

In use, the front wall 54 is received within opening 66 of circumferential sidewall 20 of cover 14, when cover 14 is in the locked position. In order to rotate cover 14 with respect to base 12, the user depresses locking button 52, pushing the locking button 52 along the radial inward direction, allowing cover 14 to be selectively rotated. The cover 14 is rotated until opening 66 allows access to the desired one of compartments 32, as shown in FIG. 1. Once pill P has been dispensed, the cover 14 may be returned to the locked position, with biasing members 60 forcing front wall 54 of locking button 52 back into opening 66.

Additionally, in order to further secure locking button 52 within locking recess 34, and also ensure proper alignment of locking button 52 therein, at least one locking rib 58 is formed on an outer face of each sidewall 56 of the locking button 52, as best shown in FIG. 4. At least one complementary locking groove 42 is formed in an inner face of each of the locking sidewalls 38 for receiving the locking ribs 58.

It is to be understood that the present invention is not limited to the embodiments described above, but encompasses any and all embodiments within the scope of the following claims.

I claim:

1. A pill dispenser, comprising:

a base having a lower wall and a plurality of radially extending inner walls mounted on an upper surface of the lower wall, the plurality of radially extending inner walls defining a plurality of pill-receiving compartments therebetween, a plurality of peripheral walls being further mounted on the upper surface of the lower wall, each the peripheral wall partially extending between an adjacent pair of the plurality of radially extending inner walls to define an access opening therebetween, a locking recess being further defined in the base;

a cover rotatably mounted to the base, the cover having an upper wall and a circumferential sidewall secured to a lower surface of the upper wall, an opening being formed in the circumferential sidewall;

at least one rib formed on an outer face of each said peripheral wall of said base and a circumferential groove formed on an inner face of the circumferential sidewall of said cover for receiving the plurality of ribs, whereby the cover is rotatably secured to the base;

a locking button received within said locking recess for selectively locking rotation of the cover with respect to the base, said locking button including a front wall, a pair of sidewalls, a support mounted to a rear face of the front wall, and at least one biasing member mounted to the support, whereby the cover is selectively rotated to align the opening formed through the circumferential sidewall thereof with a selected one of the access openings, providing access to one of the pill-receiving compartments.

2. The pill dispenser as recited in claim 1 further comprising a pair of locking sidewalls and a locking rear wall mounted on the upper surface of the lower wall of said base, the locking sidewalls and locking rear wall defining the locking recess.

3. The pill dispenser as recited in claim 2, further comprising an engaging member mounted to the upper surface of the lower wall of said base adjacent the locking rear wall, the locking button support having an opening formed therethrough adapted for slidably receiving the engaging member, whereby the at least one biasing member contacts a front face of the locking rear wall and the front wall of said locking button extends across the opening formed in the circumferential sidewall of said cover, preventing rotation thereof, when the cover is in a locked position.

4. The pill dispenser as recited in claim 3, wherein at least one locking rib is formed on an outer face of each said sidewall of said locking button, at least one locking groove being formed in an inner face of each said locking sidewall for receiving the locking ribs.

5. The pill dispenser as recited in claim 1, further comprising:

a central hub mounted on the upper surface of the lower wall of said base, an axial bore being formed therethrough; and a shaft centrally mounted on the lower surface of the upper wall of said cover, the shaft being received within the axial bore.

6. A pill dispenser, comprising:

a base having a lower wall and a plurality ofradially extending inner walls mounted on an upper surface of the lower wall, the plurality of radially extending inner walls defining a plurality of pill-receiving compartments therebetween, the base having a plurality of peripheral walls on the upper surface of the lower wall, each of the peripheral walls partially extending between an adjacent pair of the plurality ofradially extending inner walls to define an access opening therebetween, a locking recess being further defined in the base, a central hub being further mounted on the upper surface of the lower wall of the base, an axial bore being formed therethrough;

a cover rotatably mounted to the base, the cover having an upper wall and a circumferential sidewall extending from a lower surface of the upper wall, an opening being formed in the circumferential sidewall;

a shaft being centrally mounted on the lower surface of the upper wall of the cover, the shaft being received within the axial bore of the base;

at least one rib formed on an outer face of each said peripheral wall of said base and a circumferential groove formed on an inner face of the circumferential sidewall of said cover for receiving the plurality of ribs, whereby the cover is rotatably secured to the base; and a locking button received within said locking recess for selectively locking rotation of the cover with respect to the base, said locking button including a front wall, a pair of sidewalls, a support mounted to a rear face of the front wall, and at least one biasing member mounted to the support, whereby the cover is selectively rotated to align the opening formed through the circumferential sidewall thereof with a selected one of the access openings, providing access to one of the pill-receiving compartments.

7. The pill dispenser as recited in claim 6, further comprising a pair of locking sidewalls and a locking rear wall mounted on the upper surface of the lower wall of said base, the locking sidewalls and locking rear wall defining the locking recess.

8. The pill dispenser as recited in claim 7, further comprising an engaging member mounted to the upper surface of the lower wall of said base, adjacent the locking rear wall, the support of the locking button having an opening formed therethrough adapted for slidably receiving the engaging member, whereby the at least one biasing member contacts a front face of the locking rear wall and the front wall of said locking button extends across the opening formed in the circumferential sidewall of said cover, preventing rotation thereof, when the cover is in a locked position.

9. The pill dispenser as recited in claim 8, wherein each said sidewall of said locking button has an outer face having at least one locking rib formed thereon, each said locking sidewall having an inner face having at least one locking groove formed there for receiving the locking ribs.

10. The pill dispenser as recited in claim 6, wherein said base is circular.

11. The pill dispenser as recited in claim 10, wherein said cover is circular.

* * * * *